US005279093A

United States Patent [19]

Mead

[11] Patent Number: 5,279,093

[45] Date of Patent: Jan. 18, 1994

[54] COMPOSITE GIRDER WITH APPARATUS AND METHOD FOR FORMING THE SAME

[75] Inventor: Edwin L. Mead, Pittsburgh, Pa.

[73] Assignee: Mulach Parking Structures Corp., Bridgeville, Pa.

[21] Appl. No.: 805,528

[22] Filed: Dec. 11, 1991

[51] Int. Cl.[5] ..... E04C 3/20; E04C 3/294

[52] U.S. Cl. ..... 52/724

[58] Field of Search ..... 52/334, 335, 723, 724, 52/727, 660; 706/823

[56] References Cited

U.S. PATENT DOCUMENTS

| | | | |
|---|---|---|---|
| 1,728,265 | 9/1929 | Farnham et al. | 52/238 |
| 1,746,625 | 2/1930 | White | 52/660 |
| 1,768,626 | 7/1930 | Pedersen . | |
| 1,860,205 | 5/1932 | Schenker | 52/727 |
| 2,382,138 | 8/1945 | Cueni . | |
| 2,558,946 | 7/1951 | Fromson | 52/723 |
| 2,636,377 | 4/1953 | Hilpert | 52/334 |
| 3,440,793 | 4/1969 | Zehnle . | |
| 3,894,370 | 7/1975 | Parazader | 52/335 |
| 4,006,523 | 2/1977 | Mauquoy | 29/452 |
| 4,369,153 | 1/1983 | Nash et al. | 264/62 |
| 4,416,099 | 11/1983 | Fiergolla et al. | 52/319 |
| 4,493,177 | 1/1985 | Grossman | 52/745 |
| 4,495,688 | 1/1985 | Longpre et al. | 52/334 |
| 4,831,800 | 5/1985 | Nedelcu | 52/225 |
| 4,961,790 | 10/1990 | Smith et al. | 106/823 |

FOREIGN PATENT DOCUMENTS

| | | | |
|---|---|---|---|
| 676611 | 12/1963 | Canada | 52/723 |
| 1092168 | 11/1954 | France | 52/723 |
| 1253986 | 1/1961 | France | 52/334 |
| 2233464 | 1/1975 | France | 52/723 |

*Primary Examiner*—James L. Ridgill, Jr.
*Attorney, Agent, or Firm*—Buchanan Ingersoll

[57] ABSTRACT

A composite girder is described which has a steel Wide Flange beam with the top flange of the Wide Flange beam being embedded in a reinforced concrete compression member that completely encases the top flange of the Wide Flange beam and also encases a portion of the web of the Wide Flange beam adjacent the top flange. The composite girder is intended for use in constructing parking garages and has a unique slope of the upper surface on the concrete compression member to permit drainage of floors constructed when prestressed, precast concrete double tees are utilized to span the distance between adjacent composite girders. Apparatus and a method for forming the composite girder in the field have been devised which include the erection of a temporary concrete form support above the steel Wide Flange beam and the pouring of the concrete to form the concrete compression member while the temporary form is in place. The elements of the temporary form and its support may be readily transported by truck before assembly and erection.

7 Claims, 5 Drawing Sheets

COMPOSITE GIRDER WITH APPARATUS AND METHOD FOR FORMING THE SAME

BACKGROUND OF THE INVENTION

1. Field of the Invention

This invention is directed to a composite girder formed from a steel Wide Flange beam with a concrete compression member. A method of forming the composite girder in the field and the apparatus for forming the girder are provided.

2. Description of the Prior Art

Various types of structural beams utilizing combinations of metal and concrete have been proposed in the past. U.S. Pat. No. 1,768,626, French Patent 1,253,986, U.S. Pat. No. 4,416,099 and U.S. Pat. No. 4,495,688 all disclose "I" beams or joists partially enclosed in concrete for various structural purposes. U.S. Pat. No. 2,636,377, U.S. Pat. No. 3,440,793 and U.S. Pat. No. 2,382,138 disclose combinations of "I" beams and concrete reinforcement to strengthen the structural members. U.S. Pat. No. 4,831,800 and U.S. Pat. No. 4,006,523 disclose pre-stressed steel and concrete beams. U.S. Pat. No. 4,493,177 and U.S. Pat. No. 4,369,153 disclose methods and apparatus for forming pre-stressed structural members and concrete panels None of the foregoing patents discloses a composite girder that is particularly adapted for use in the erection of parking garages. The present invention is directed to such a composite girder which has a concrete cap surrounding the upper flange of a steel Wide Flange beam to serve as a compression member. The concrete compression member attaches itself to the top flange of the Wide Flange beam and the web of the Wide Flange beam. The concrete compression member is at least twice as wide as the Wide Flange beam flange that it encases and has upper surfaces which are perpendicular to the web of the Wide Flange beam but which gradually slope relative to the horizontal surface of the Wide Flange beam flange so that the composite girder may be utilized in combination with other structural members to automatically effect drainage of water from parking garage surfaces.

Because a typical Wide Flange beam of the present invention can be 65 feet long, and the concrete compression member extends the full length of the beam, it is sometime more cost efficient to manufacture the composite girder in the field than to transport it long distances. A method and apparatus have been devised for manufacturing the composite girder in the field.

SUMMARY OF THE INVENTION

In accordance with the present invention, there is provided a composite girder having a steel Wide Flange beam that in turn has a first flange, a second flange and a web interconnecting the first and second flanges Concrete reinforcing means surround the Wide Flange beam first flange and the Wide Flange beam web adjacent to the first flange. A concrete compression member is formed on the Wide Flange beam to completely encase the first flange and to encase a portion of the web adjacent to the first flange. The concrete compression member is reinforced by the reinforcing means. The concrete compression member has an upper surface generally perpendicular to the Wide Flange beam web and side surfaces generally parallel to the Wide Flange beam web with a relieved portion along each outer edge of the upper surface of the compression member. The relieved portion is stepped down from the upper surface of the compression member a uniform distance along the entire length of the composite girder.

Further, in accordance with the present invention, there is provided an apparatus for forming a concrete compression member on a steel Wide Flange beam that has a first flange, a second flange and a web interconnecting the first and second flanges. The concrete compression member encases and adheres to the first flange and a portion of the web of the Wide Flange beam. The apparatus includes means fcr supporting the Wide Flange beam in a horizontal position with the first flange above the second flange. Means are provided for supporting a frame above the Wide Flange beam in parallel relation to the Wide Flange beam. The apparatus includes a plurality of clam-shell members depending from the frame that are selectively opened and closed and that, when closed, surround the Wide Flange beam first flange and are in close proximity to the Wide Flange beam web. Form means are supported by the clam-shell members to provide a form for molding the concrete compression member that extends the length of the Wide Flange beam. The form means have the internal shape of the sides and bottom of the concrete compression member and extend into close proximity to the Wide Flange beam.

Still further in accordance with the present invention, there is provided a method of producing a composite girder from a steel Wide Flange beam that has a first flange, a second flange and a web interconnecting the first and second flanges by forming a concrete compression member on the Wide Flange beam to completely encase the first flange and a portion of the web. The method includes the steps of positioning the steel Wide Flange beam horizontally with the first flange being above the second flange. A frame is positioned above the Wide Flange beam in parallel relation to the Wide Flange beam. A plurality of clam-shell members are attached to the frame so that the clam-shell members, when closed, surround the Wide Flange beam first flange and are in close proximity to the Wide Flange beam web. Form means are secured to the clam-shell members and extend the full length of the Wide Flange beam. The clam-shell members are closed so that the form means surrounds the first flange and extends into close proximity to the web of the Wide Flange beam. Concrete is poured into the form means to form the concrete compression member and after the concrete sets, the clam-shell members are opened to remove the composite beam for use.

DESCRIPTION OF THE PREFERRED EMBODIMENT

Figure 1:
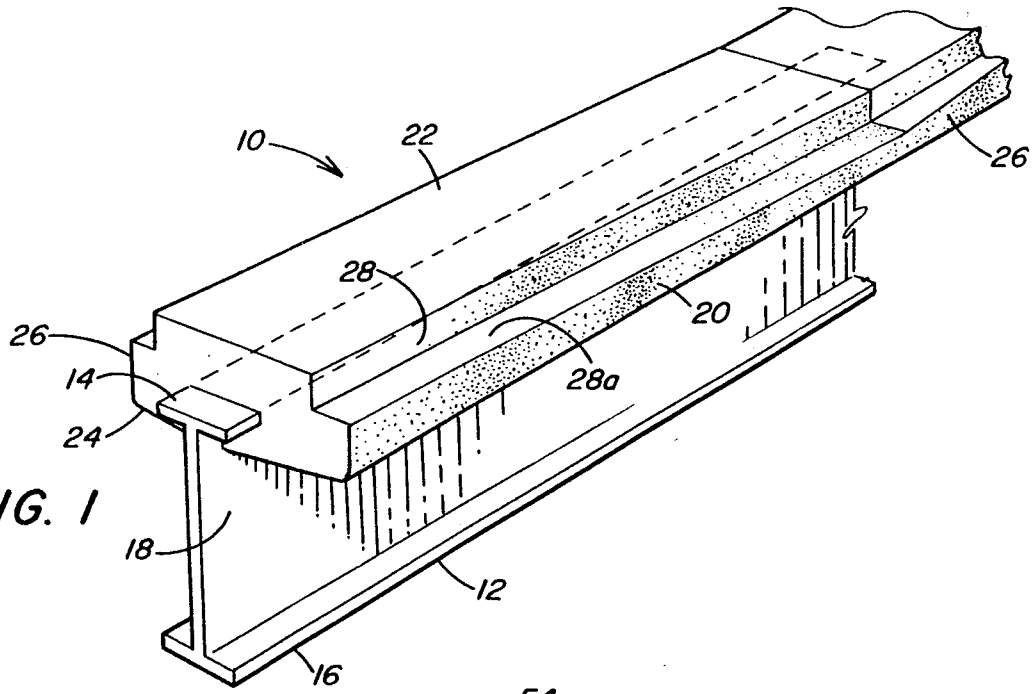
FIG. 1 is a perspective view of a portion of the composite girder of the present invention.
Figure 2:
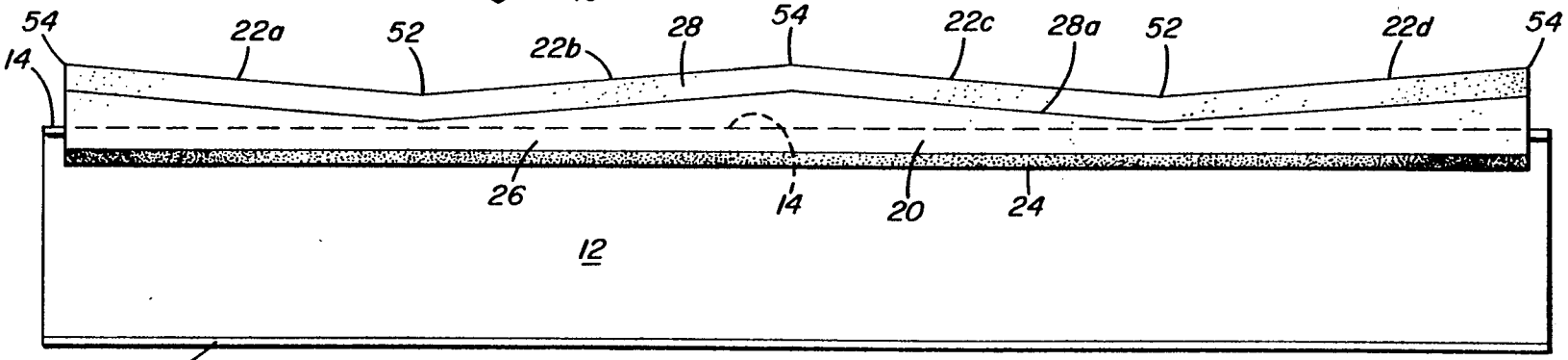
FIG. 2 is a side elevation of the composite girder of the present invention that is not to scale and shows the sloping upper surfaces of the girder in an exaggerated manner.

Referring to the drawings, and particularly to FIGS. 1 and 2, there is shown a composite girder indicated generally at 10. A steel Wide Flange beam 12, preferably formed of high-strength steel (yield strength $F_y=60$ ksi), has a first flange 14, a second flange 16 and a connecting web 18. A concrete compression member 20 is formed around the first flange 14 of Wide Flange beam 12 so that it completely encases flange 14 and a portion of the web 18 that is adjacent to first flange 14.

The concrete compression member 20 has an upper surface 22, a lower surface 24 and side surfaces 26. Rather than the upper surface 22 and the side surface 26 meeting at right angles, there is a relieved portion 28 which steps down from the upper surface 22 and forms a generally horizontal surface 28*a* of the relieved portion 28 on the concrete compression member 20.

Figure 4:
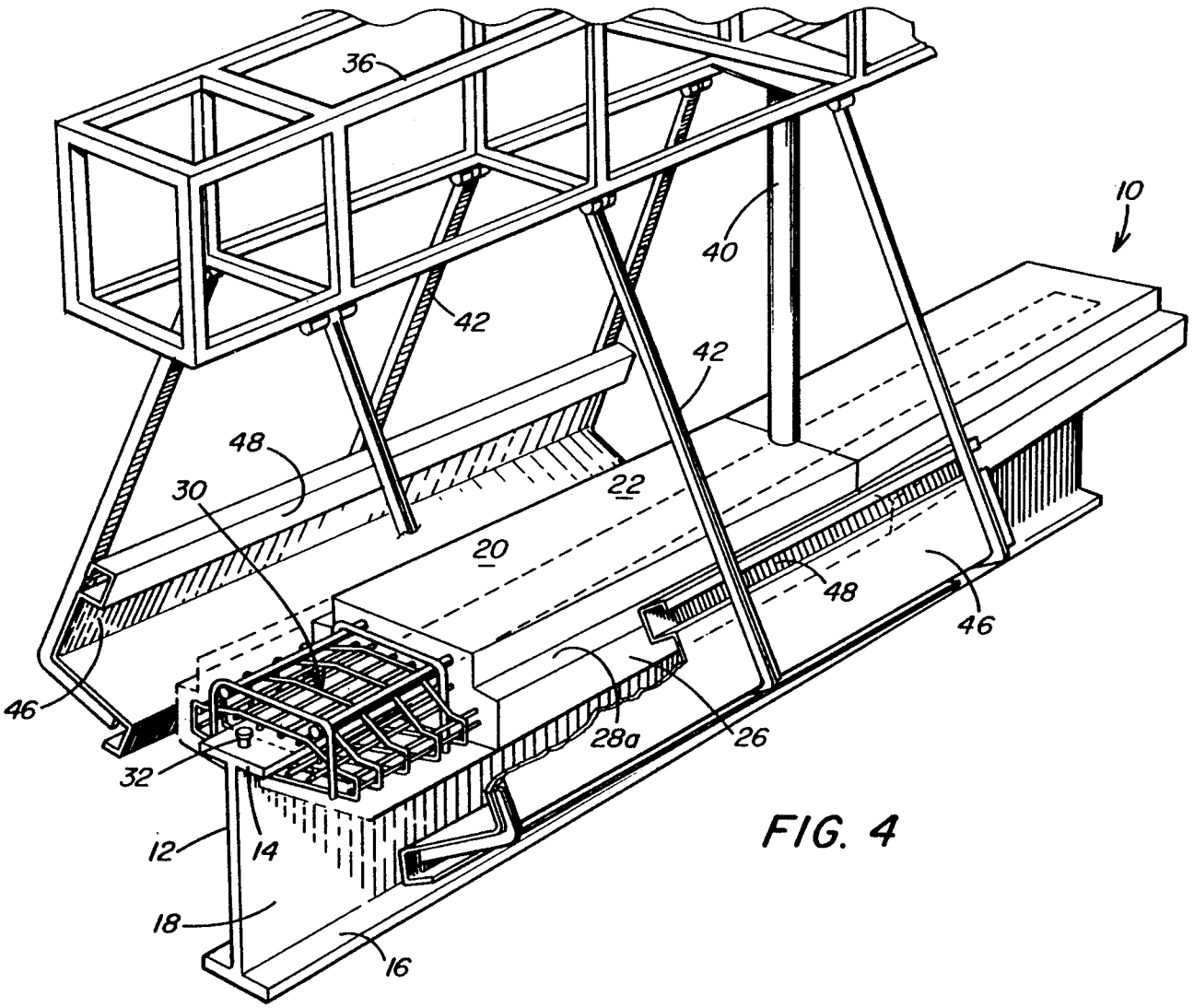
FIG. 4 is a view similar to FIG. 3 to an enlarged scale with portions broken away to show details of the composite girder and the form.
Figure 5:
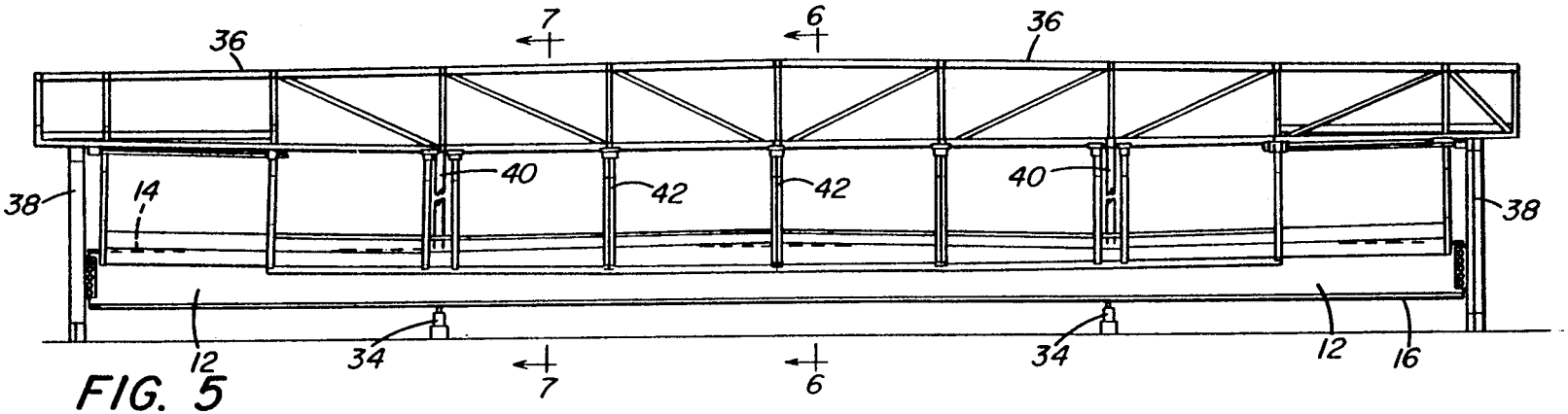
FIG. 5 is a side elevation of the composite girder and form structure in place above it.

As seen in FIG. 4, the entire length of the concrete compression member 20 contains concrete reinforcing rods and fabric indicated generally at 30 on FIG. 4. A series of studs 32 may also be welded to the top of Wide Flange beam first flange 14 to increase the adherence between the concrete compression member 20 and the steel Wide Flange beam 12. The concrete compression member 20 adds lateral support to the girder 10 that eliminates the need for other lateral supporting structures. A Wide Flange beam having a length of 65 feet would require lateral support through its length to provide structural integrity.

Although the composite girder 10 of the present invention has many structural uses, the embodiment shown is particularly adapted for construction of parking garages which require certain unique characteristics. The composite girder 10 is preferably formed with silica fume concrete being utilized for the concrete compression member 20. When used in a parking garage, the composite girder 10 may typically be approximately 65 feet in length. The girder 10 spans the various ramps in the parking garage and adjacent girders 10 are located anywhere from 20 feet to 35 feet from each other. Pre-stressed concrete double "T" sections span the distance between adjacent composite girders 10 and form the floor of the parking garage and its ramps.

Because of the need to drain water from parking garages, the top surface 22 of the concrete compression member 20 is not uniformly parallel to the first flange 14 of the Wide Flange beam 12. Rather, as shown in exaggerated fashion in FIG. 2, the concrete compression member 20 has sloping surfaces 22*a*, 22*b*, 22*c* and 22*d*. The sloping surfaces 22*a*, 22*b*, 22*c* and 22*d* are perpendicular to the web 18 of Wide Flange beam 12 throughout. As seen in FIG. 2, surfaces 22*a* and 22*b* come together at a low point 52 relative to the first flange 14 of Wide Flange beam 12. In like fashion, surfaces 22*c* and 22*d* come together at a low point 52. Surfaces 22*b* and 22*c* come together at a high point 54. The high points 54 are located at approximately each end of girder 10 and at the center of girder 10 through its length. The low points 52 are located approximately one quarter of the way in from each end of composite girder 10. The relieved portion 28 at the top of the concrete compression member 20 is uniform throughout the length of the composite girder 10 so that the generally horizontal surface 28*a* of the relieved portion 28 remains parallel to the upper surface 22 of the concrete compression member 20 and slopes relative to the first flange 14 of Wide Flange beam 12 in the same manner that the surfaces 22*a*, 22*b*, 22*c* and 22*d* slope relative to the first flange 14. The high points 54 on FIG. 2 are only approximately two to four inches higher than the low points 52 so that it can readily be seen that FIG. 2 is exaggerated in scale since the entire composite girder 10 is approximately 65 feet in length.

Figure 6:
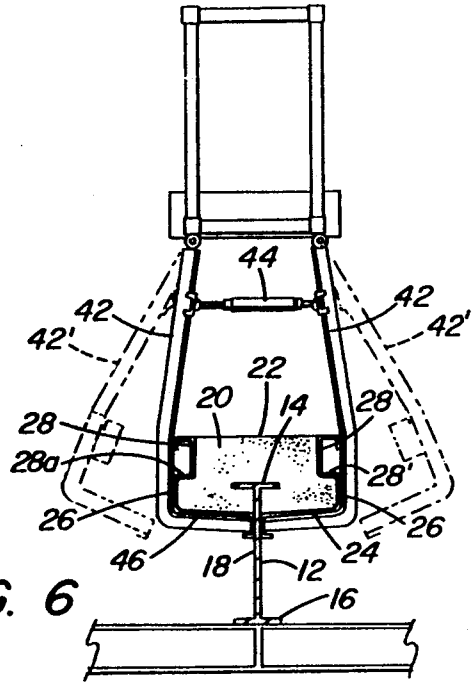
FIG. 6 is a sectional view taken along Line 6—6 of FIG. 5.
Figure 7:
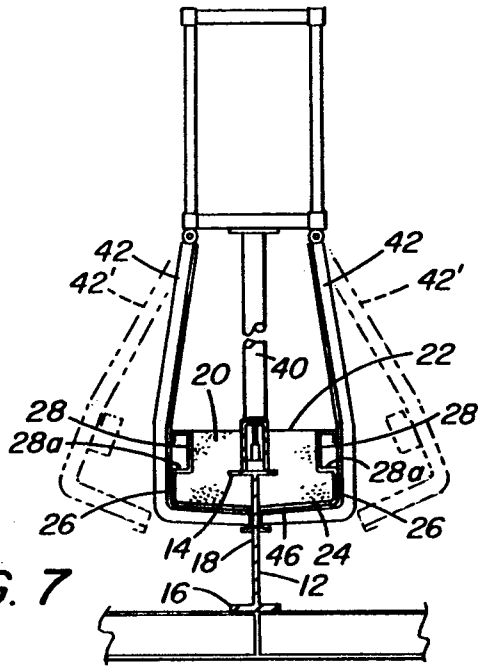
FIG. 7 is a sectional view taken along Line 7—7 of FIG. 5.

Referring now to FIGS. 3 through 7, there is shown the Wide Flange beam 12 supported horizontally above the ground with the first flange 14 above the second flange 16. Intermediate supports 34 (FIG. 5) and end supports 38 support the Wide Flange beam horizontally. A tubular boxed truss frame member 36 is supported above the Wide Flange beam 12 by end supports 38 and intermediate supports 40 that are directly above supports 34. The intermediate supports 40 actually rest on the top of the first flange 14 of Wide Flange beam 12 as shown in FIG. 7.

Pivotally depending from frame member 36 are clam-shell members 42 best seen in FIGS. 6 and 7. As seen in FIGS. 6 and 7, the clam-shell members 42 are in their closed position. When activated by a hydraulic piston and cylinder 44, the individual clam-shell members 42 may be opened to the position 42′ as shown in phantom lines in FIGS. 6 and 7. The hydraulic piston and cylinder 44 operate in conventional fashion to open and close the clam-shell members 42.

Figures 3, 9:
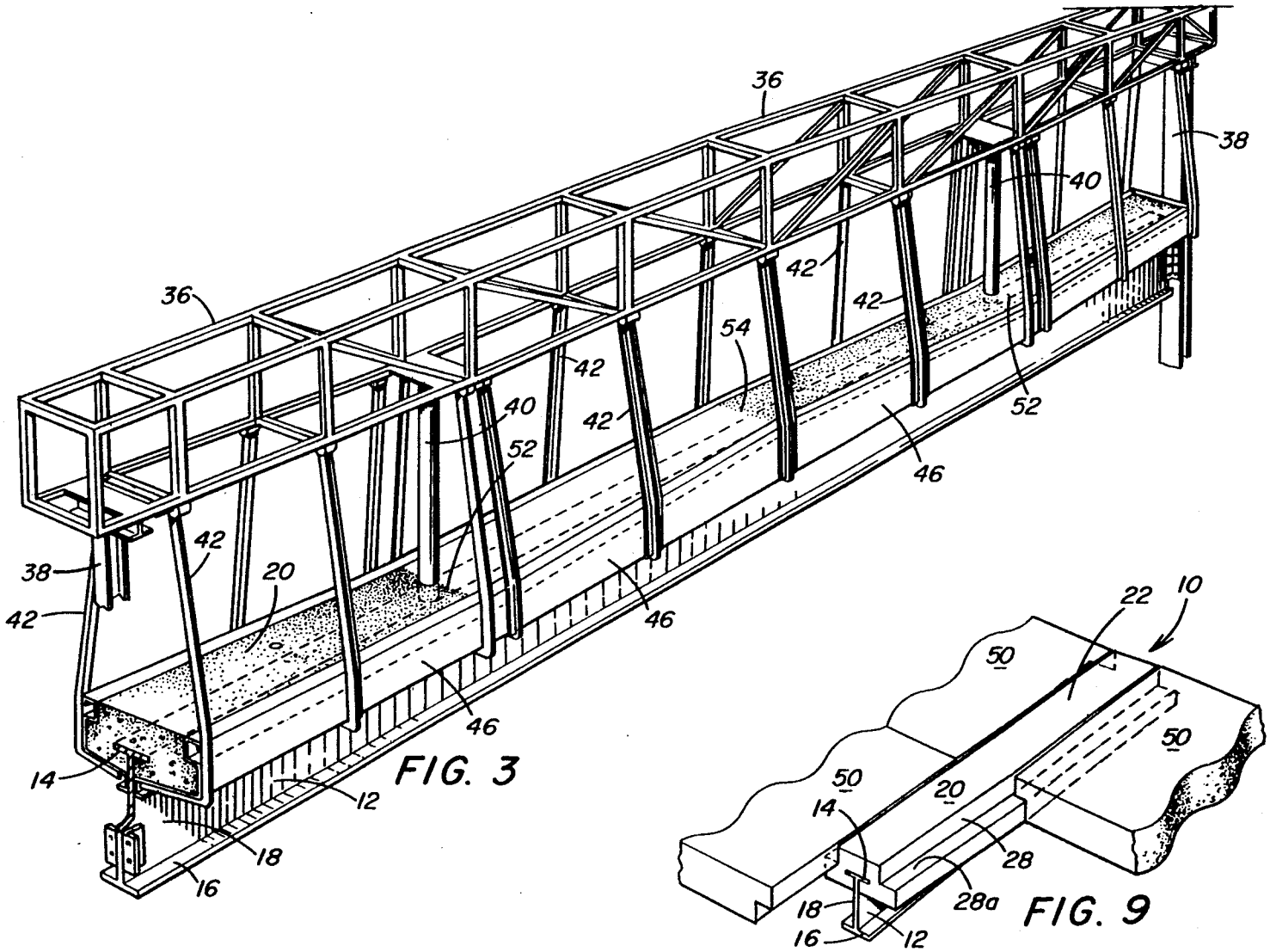
FIG. 3 is a perspective view of the concrete form for manufacturing the composite girder shown with the composite girder in place.
FIG. 9 is a perspective view of a single composite girder supporting pre-stressed, precast concrete double tees.

Secured to the bottom of clam-shell members 42 are form members 46 best seen in FIGS. 3 and 4. The form members 46 are provided in short sections for ready transportation. Form members 46 provide the concrete form to mold the concrete compression member 20. The form members 46 are attached to the clam-shell members 42 and move with the clam-shell members when they are opened and closed. The form members 46 have the relief form 48 provided near the top of the form members 46 to form the relief portion 28 on concrete compression member 20.

As seen in FIG. 3, the clam-shell members 42 are closed and the form members 46 surround the first flange 14 of Wide Flange beam 12 and are in close proximity to the web 18 of Wide Flange beam 12. When the form members 46 are positioned as shown in FIG. 3 around the first flange 14 of Wide Flange beam 12, the concrete to form the concrete compression member 20 is poured into the form and allowed to set. After the concrete sets, the clam-shell members 42 are opened as shown in FIG. 4 and the composite girder 10 may be removed for use.

Figure 8:
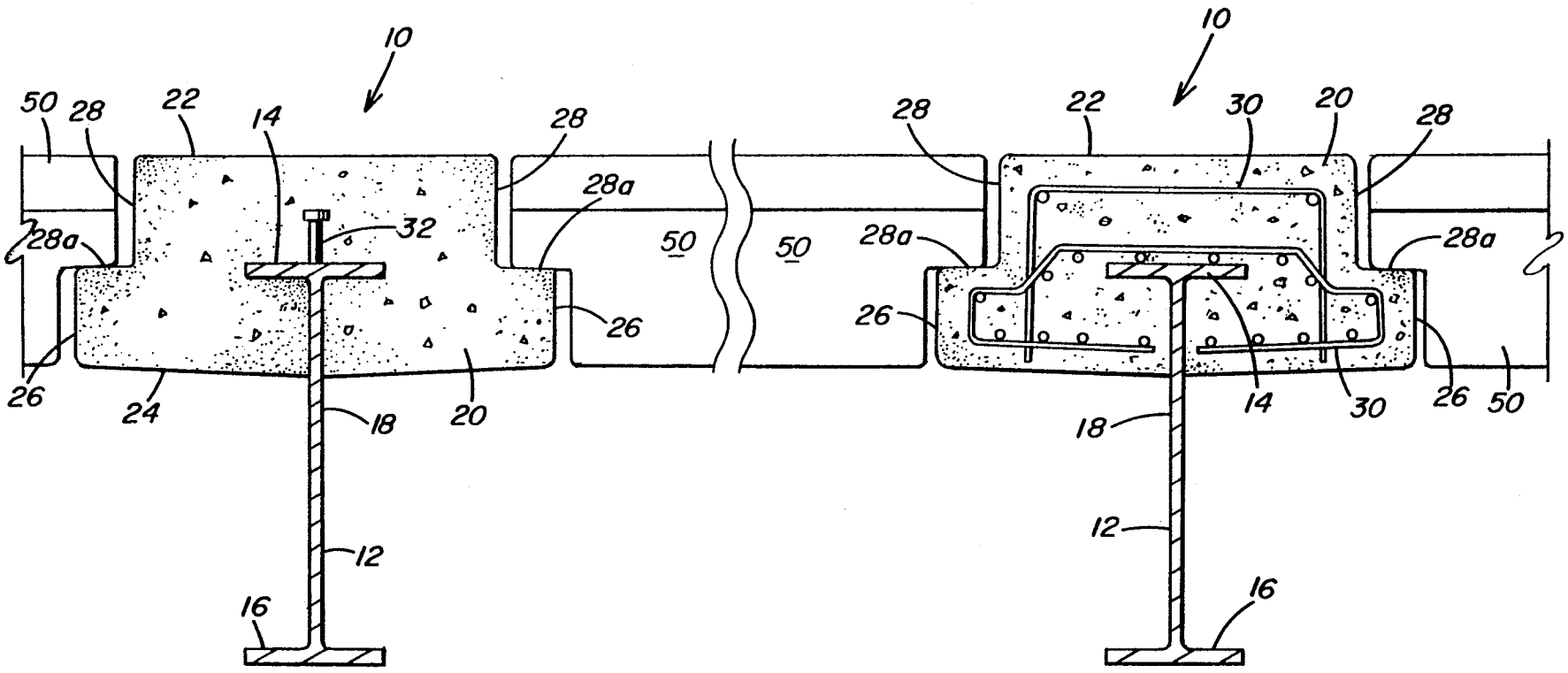
FIG. 8 is a sectional end view of two composite girders of the present invention supporting pre-stressed, precast concrete double tees.

FIGS. 8 and 9 illustrate the manner in which composite girders 10 are utilized in the construction of parking garages. As seen in FIG. 8, two composite girders 10 are located parallel to each other. Pre-stressed, precast concrete double tees 50 are supported on the horizontal surface 28*a* of relief portion 28 of the concrete compression member 20. The precast double tees 50 span the distance between composite girders 10 and provide the floor of the garage. FIG. 9 illustrates in perspective view the manner in which the double tees 50 rest upon a single composite girder 10. Because the surface 28*a* follows the sloping top surface 22 of the compression member 20, the double tees 50 will be angled slightly toward each other to permit water drainage.

Two types of composite beams are recognized by the American Institute of Steel Construction specifications: (1) a totally concrete encased steel member and (2) a beam that is not totally encased but has the concrete connected to the steel beam with mechanical fasteners. Because the composite girder 10 of the present invention is neither of these recognized types, the composite girder 10 of the present invention was extensively tested to be sure that the assumptions made by way of strength and performance in designing the girder 10 were accurate. The tests verified the following conclusions:

(a) full composite action was developed between the steel Wide Flange beam 12 and the concrete compression member 20;

(b) the use of a silica fume concrete for the compression member 20 enhanced the performance of the composite girder by permitting a higher compressive stress and 24 hour stripping of steel forms;

(c) the natural adhesion that exists between the embedded steel flange 14 and the silica fume concrete compression member 20 is sufficient to develop full composite action between these elements;

(d) it is preferable that the portion of the Wide Flange beam 12 that is embedded in the compression member 20 be unpainted to enhance the natural adhesion that exists between them;

(e) stresses obtained from measured strains were lower than the theoretical stresses computed by an elastic analysis assuming a prismatic cross-section;

(f) the full depth of the uncracked concrete compression member 20 could be used in computing the mechanical properties of the cross-section; and (g) the concrete compression member 20 provided sufficient lateral stiffness to prevent lateral buckling of the girder 10 thus eliminating the need for additional lateral support members for the composite girder 10.

As seen in FIGS. 1 and 8, the total width of the concrete compression member 20 is substantially more than twice the width of the first flange 14. This substantial width of the concrete compression member 20 resists side loads and provides the lateral stiffness found in the tests.

According to the provisions of the patent statutes, I have explained the principle, preferred construction and mode of operation of my invention and have illustrated and described what I now consider to represent it best embodiment. However, it should be understood, that within the scope of the appended claims, the invention may be practiced otherwise than as specifically illustrated and described.

I claim:

1. An individual composite girder that may be removed for use after being formed comprising:

a steel Wide Flange beam having a first compression flange, a second tension flange and a web interconnecting said first and second flanges;

concrete reinforcing means surrounding said Wide Flange beam first flange and said Wide Flange beam web against said first flange;

a concrete compression member formed on said Wide Flange beam to completely encase said first flange and to encase a portion of said web adjacent to said first flange, said concrete compression member encasing the top, compression flange of said Wide Flange beam and being reinforced by said reinforcing means, said concrete compression member being at least twice as wide as said Wide Flange beam first flange;

said concrete compression member having an upper surface generally perpendicular to said Wide Flange beam web that slopes to low points relative to said Wide Flange beam first flange located substantially one forth of the way toward the center from each end of said composite girder and is at high points relative to said Wide Flange beam first flange at substantially the center and at each end of said composite girder and side surfaces generally parallel to said Wide Flange beam web.

2. The composite girder of claim 1 wherein said Wide Flange beam is high-strength steel.

3. The composite girder of claim 1 wherein said concrete compression member is formed from silica fume concrete.

4. The composite girder of claim 1 wherein said Wide Flange beam is unpainted on the surfaces encased by said concrete compression member.

5. An individual composite girder that may be removed for use after being formed comprising:

a steel Wide Flange beam formed from high-strength steel having a first compression flange, a second tension flange and a web interconnecting said first and second flanges;

concrete reinforcing means surrounding said Wide Flange beam first flange and said Wide Flange beam web against said first flange;

a concrete compression member formed from silica fume concrete on said Wide Flange beam to completely encase said first flange and to encase a portion of said web adjacent to said first flange; said concrete compression member encasing the top, compression flange of said Wide Flange beam and being reinforced by said reinforcing means and having a width at least twice the width of said Wide Flange beam first flange;

said concrete compression member having an upper surface generally perpendicular to said Wide Flange beam but sloping longitudinally relative to said Wide Flange beam first flange that slopes to low points relative to said Wide Flange beam first flange located substantially one forth of the way toward the center from each end of said composite girder and is at high points relative to said Wide Flange beam first flange at substantially the center and at each end of said composite girder and side surfaces generally parallel to said Wide Flange beam web, with a relieved portion along each outer edge of said upper surface and stepped down from said upper surface a uniform distance along the entire length of said composite girder.

6. The composite girder of claim 5 wherein studs are welded to said Wide Flange beam first flange to enhance the adhesion between said Wide Flange beam and said concrete compression member.

7. The composite girder of claim 5 wherein said relieved portion along each outer edge of said concrete compression member receives and supports prestressed, precast concrete double tees.

* * * * *

UNITED STATES PATENT AND TRADEMARK OFFICE

CERTIFICATE OF CORRECTION

PATENT NO. : 5,279,093
DATED : January 18, 1994
INVENTOR(S) : EDWIN L. MEAD

It is certified that error appears in the above-indentified patent and that said Letters Patent is hereby corrected as shown below:

Column 5, line 64, claim 1, change "against" to --adjacent--.

Column 6, line 34, claim 5, change "against" to --adjacent--.

Column 6, line 40, claim 5, after "beam" insert--,-- and delete "and".

Signed and Sealed this

Thirty-first Day of May, 1994

Bruce Lehman

*Attest:*

BRUCE LEHMAN

*Attesting Officer*

*Commissioner of Patents and Trademarks*